US006551261B1

(12) United States Patent
Jun

(10) Patent No.: US 6,551,261 B1
(45) Date of Patent: Apr. 22, 2003

(54) BAMBOO MASSAGE STICK

(76) Inventor: Jung Chan Jun, 405, Shipjung 2-dong, Bupyeong-ku, Incheon (KR), 403-132

( * ) Notice: Subject to any disclaimer, the term of this patent is extended or adjusted under 35 U.S.C. 154(b) by 0 days.

(21) Appl. No.: 09/553,154

(22) Filed: Apr. 20, 2000

(30) Foreign Application Priority Data

Apr. 21, 1999 (KR) ..... 99-6634
Dec. 16, 1999 (KR) ..... 99-58228

(51) Int. Cl.[7] ..... A61H 23/06
(52) U.S. Cl. ..... 601/107
(58) Field of Search ..... 601/107, 136, 601/137, 134, 41, 6; 606/201, 204; D24/200, 214, 211; 131/246, 247; 135/65–66, 72

(56) References Cited

U.S. PATENT DOCUMENTS

| | | | | |
|---|---|---|---|---|
| 233,758 | A | * 10/1880 | Holbrook | |
| 1,212,443 | A | * 1/1917 | Blaine | |
| 1,915,190 | A | * 6/1933 | Koment | |
| 2,054,849 | A | * 9/1936 | Briggs | 128/54 |
| 3,750,677 | A | * 8/1973 | Jodoin | 131/181 |
| 3,765,428 | A | * 10/1973 | Beam | 131/196 |
| 4,231,834 | A | * 11/1980 | Gonzalez | 156/294 |
| 4,286,607 | A | * 9/1981 | Claessens | 131/187 |
| D270,280 | S | * 8/1983 | Epstein | D24/41 |
| 4,604,088 | A | * 8/1986 | Nottbohm | 131/175 |
| 4,927,402 | A | * 5/1990 | Fables et al. | 446/119 |
| D343,234 | S | * 1/1994 | Williams | D24/133 |
| 5,367,946 | A | * 11/1994 | Yasunaga | 99/286 |
| D414,295 | S | * 9/1999 | Coleman | D28/7 |
| 5,996,589 | A | * 12/1999 | St. Charles | 131/273 |
| 6,418,936 | B1 | * 7/2002 | Lee | 131/178 |

FOREIGN PATENT DOCUMENTS

| | | | |
|---|---|---|---|
| DE | 535986 | * 10/1931 | 601/107 |
| GB | 000172215 A | * 12/1921 | |
| GB | 404235 | * 1/1934 | 601/107 |
| KR | 1995-29544 | 11/1995 | A61H/23/06 |
| KR | 1997-32778 | 7/1997 | A61H/23/06 |

OTHER PUBLICATIONS

The Tea Ceremony, Japan Access.*
Bamboo Spoons and Ladle, Copyright 2001 LinanEuro–China Co LTD.*
Bamboo Ladle / Hishaku, Zen Home Decor Fen Shui, Meditation Si & Select Japanese Gifts.*
Ode to Bamboo Phil Abbey Apr. 18, 1999.*

* cited by examiner

*Primary Examiner*—Justine R. Yu
(74) *Attorney, Agent, or Firm*—Jacobson Holman PLLC

(57) ABSTRACT

A bamboo massage stick according to the invention comprises a massage portion having a culm portion at end thereof and a shaft. The massage portion is coupled to the shaft in the configuration of "]" or letter "T". The whole weight of the massage stick is light because it is made of bamboo, and has advantage in that the massage stick has therapeutic value by use of compressed air. The massage stick can be produced on a large scale by simple manufacturing process.

14 Claims, 6 Drawing Sheets

BAMBOO MASSAGE STICK

BACKGROUND OF THE INVENTION

FIELD OF THE INVENTION

The present invention relates generally to massage stick made of bamboo, and more particularly to an improved portable massage stick having a light weight, because of being made of bamboo, and also therapeutic effect by utilizing air pressure. This massage stick can be adapted to be manufactured in commercial quantity with improved productivity.

BACKGROUND OF THE INVENTION

So far many massage instruments using electric vibration or being operated manually have been introduced. However, these instruments have some disadvantage, e.g. Their weight and configuration are not suitable for use by oneself, particularly to older people.

In order to overcome the disadvantage mentioned above, massage instruments made of bamboo are previously known from Korean Patent Publication No. 97-32778 and Korean Utility Model Publication No. 95-29544. The massage instruments disclosed in the reference documents consist of plural bamboo strips of predetermined length and diameter.

Though these instruments can reduce their weight by use of bamboo as materials, these instruments still have such problems as not being able to pat the concave point of the human body and cannot be produced on a large scale on account of a complicated, detailed manufacturing process.

SUMMARY OF THE INVENTION

The present invention is developed in order to overcome the disadvantage mentioned above in connection with previously known massage instruments and to provide an improved massage instrument. Thus, a primary object of the invention is to create a massage instrument whose weight is light, thereby suitable to be used by oneself, and that makes it possible to infiltrate a soft impact wave into body through air pressure to activate the circulation of the blood.

A further object of the invention is to provide massage instrument that can be simply manufactured with increased production efficiency.

DESCRIPTION OF THE INVENTION

The above objects of the present invention are accomplished by the bamboo massage stick comprising a massage portion 2 equipped with culm portion 3 at one or both ends thereof and having space with which air is compressed therein when said portion 2 contacts with human body, and a shaft 4 whose one end may be connected to the massage portion 2 in the configuration of "]" or letter "T" and provided with a grip at the other end.

Referring to accompanying drawings the preferred embodiments according to the invention will be described.

Figure 1:
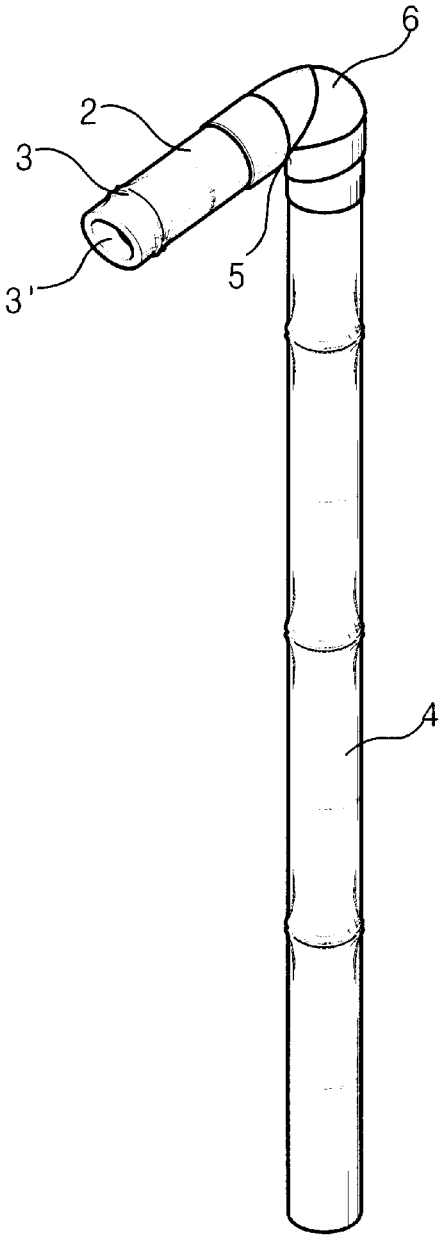
FIG. 1 is a perspective view of the massage stick of the first embodiment according to the invention.

FIG. 1 illustrates the first embodiment of the massage stick according to the invention.

In this embodiment, bamboo stick having the predetermined length is partially cut at a certain portion to be separated into two parts, but not completely divided, then two parts is made to be curved at a predetermined angle to form massage portion 2 and shaft 4.

More particular massage portion 2 having a culm portion 3 at one end thereof and shaft 4 is curved to form acute angle each other, and then curved portion 5 is taped with a tape member 6 to maintain the curved state.

Figure 2:
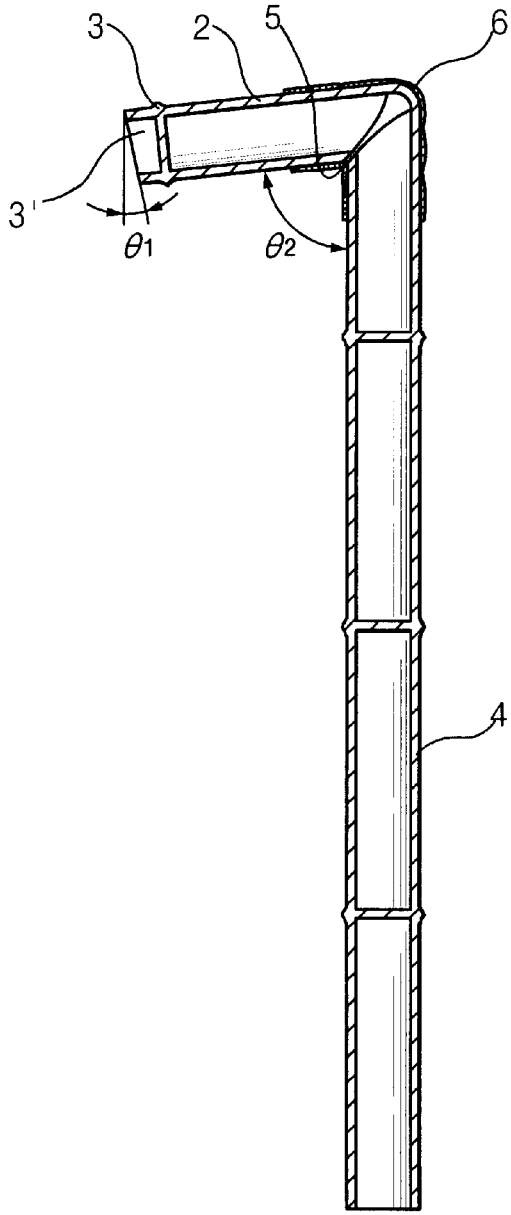
FIG. 2 is a cross sectional view of the stick showed in FIG. 1.

Referring to FIG. 2 the front end of massage portion 2 may be inwardly cut, so that end surface of massage portion 2 become incline at angle $\theta_1$ relative to vertical line parallel to shaft 4.

It is preferable that the length of shaft 4 is about 40 cm and massage portion 2 about 7 cm.

With above construction such that massage portion 2 includes culm portion 3 at end portion thereof, air is compressed in the space 3' formed between culm portion 3 and human body when massage portion 2 pat a human body, then a soft impact wave infiltrate into the human body to become reverse code of disease code, thereby effecting therapeutic treatment. Further impact applied to human body is moderated by the above compressed air.

Further a user can pat for long period time as the entire weight of the massage stick is light, exercise and stretching effect is also attained in connection with the pat on the back.

Considering the above excellent effect, the cut angle $\theta_1$ of massage portion 2 is ranged at an angle of 10 degrees to 14 degrees, preferably 12 degrees, and the angle $\theta_2$ of the curved portion between massage portion 2 and shaft 4 at an angle of 82 degrees to 85 degrees, preferably 84 degrees.

Figure 3:
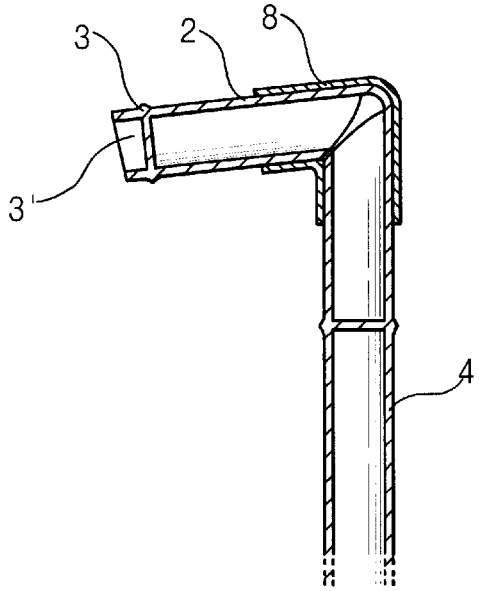
FIG. 3 is a cross sectional view of the massage stick of the second embodiment according to the invention.

FIG. 3 illustrates the second embodiment of the massage stick according to the invention, the massage stick being curved by tubular member 8 made of thermoplastic.

In more detail, the bamboo stick is inserted into the tubular member 8 having larger inner diameter than outer diameter of the massage stick after being cut similarly in the first embodiment, then tubular member 8 together with the massage stick is gradually curved until it reaches the above angle $\theta_2$, thereafter the tubular member 8 is cooled by coolant such as cold water to fix the curved state.

Figure 4:
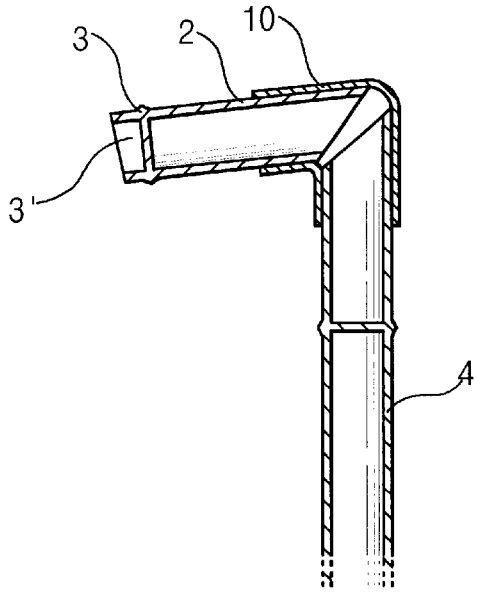
FIG. 4 is a cross sectional view of the massage stick of the third embodiment according to the invention.

FIG. 4 illustrates the third embodiment of the massage stick according to the invention.

In accordance with this embodiment massage portion 2 and shaft 4 is separately prepared, and then inserted individually into both ends of curved coupling member 10, said coupling member 10 being curved at angle 02.

Preferably this coupling member 10 may be manufactured from such light material as aluminum or thermoplastic and the like in order not to increase the weight of bamboo massage stick.

Since in this embodiment massage portion 2 and shaft 4 is separately prepared, which is different from the previous embodiment in that both parts must be manufactured from single bamboo stick, this embodiment has the advantage that can use bamboo material more practical than the previous embodiment.

FIG. 5 to FIG. 9 illustrate the fourth through the sixth embodiments of the massage stick according to the invention. In the embodiment according to FIG. 5 to FIG. 9, the massage stick can be produced on a large scale due to increased production efficiency.

Figure 5:
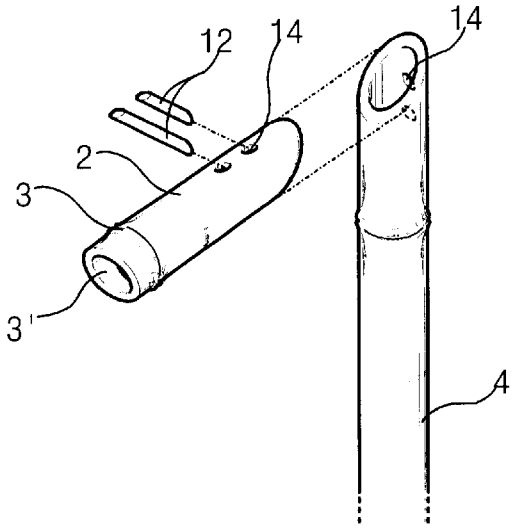
FIG. 5 is a perspective view of the massage stick of the fourth embodiment according to the invention.

As regarding FIG. 5 the single bamboo stick having a predetermined length is cut away, at an angle of 45 degrees relative to the longitudinal axis, into two parts, and then a plurality of through holes 14 are formed near the cutting surface of the two parts in such way that corresponding pin members 12 can be inserted into the through holes 14 at right angles to the cutting surface.

Figure 6:
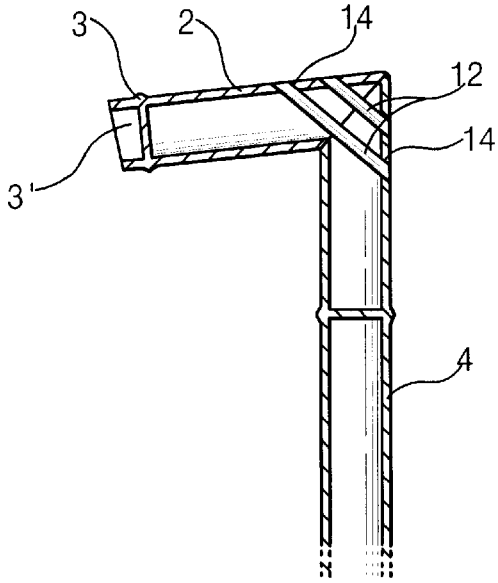
FIG. 6 is a cross sectional view of the stick showed in FIG. 5.

As shown in FIG. 6, after adhesive is applied on the cutting surface of each part, a number of pin members 12, two in this embodiment, are fitted into the through hole 14 with both cutting surface of two parts abutted each other.

The above construction makes it possible to produce the massage stick on a large scale because it needs not tubular member 8 or coupling member 10 whose inner diameter must be substantially equal to the outer diameter of the bamboo stick.

Though in this embodiment massage portion 2 and shaft 4 are manufactured from single bamboo stick, it is also possible to prepare two parts separately, e.g. using different bamboo sticks.

Figure 7:
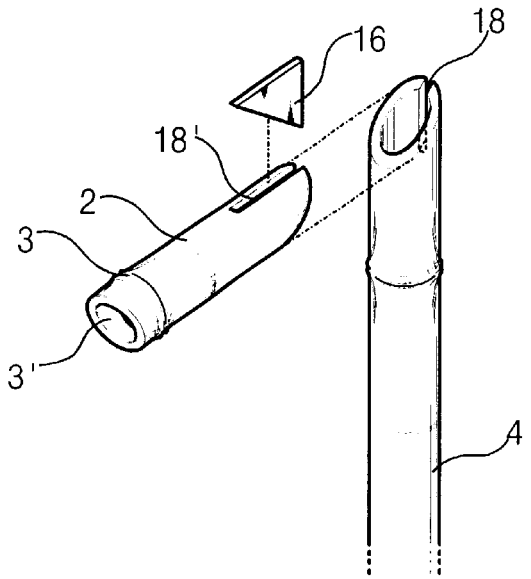
FIG. 7 is a perspective view of the massage stick of the fifth embodiment according to the invention.

FIG. 7 illustrates the fifth embodiment according to the invention, instead of plural pin members 12, segmental plate 15 in the shape of triangle is used for fixing the massage portion 2 to the shaft 4.

Figure 8:
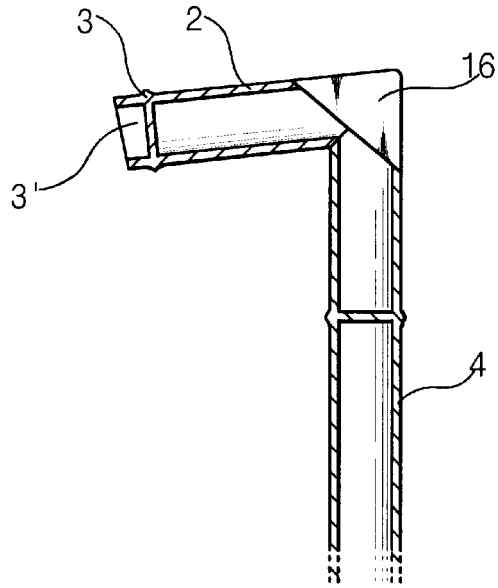
FIG. 8 is a cross sectional view of the stick showed in FIG. 7.

After the single bamboo stick is cut away at an angle of 45 degrees into two parts, at each cutting surface of two parts slits 18, 18' are formed to accommodate the segmental plate 16. FIG. 8 illustrates a cross section of the assembled state that massage portion 2 and shaft 4 are coupled through the segmental plate 16.

Figure 9:
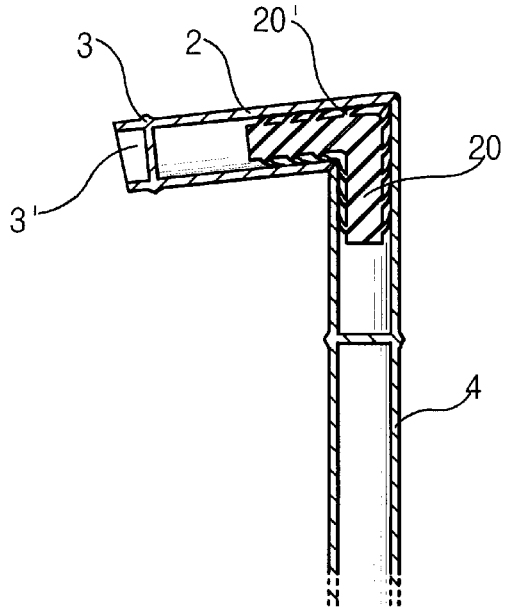
FIG. 9 is a cross sectional view of the massage stick of the sixth embodiment according to the invention.
Figure 10:
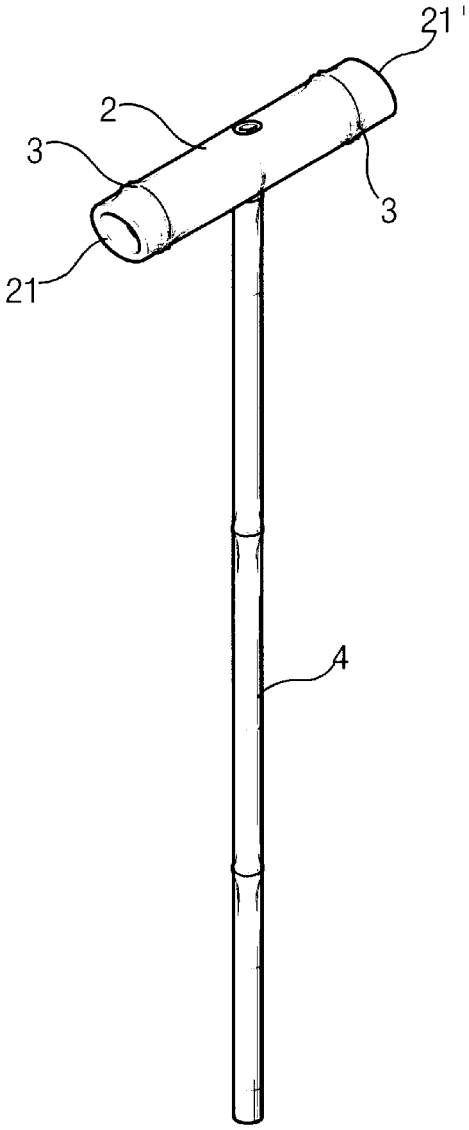
FIG. 10 is a perspective view of the massage stick of the seventh embodiment according to the invention.

FIG. 9 illustrates the sixth embodiment according to the invention, an insert member 20 being used for fixing the massage portion 2 to the shaft 4.

The insert member 20 in the shape of "]" is made of rigid material to be capable of maintaining the curved angle $\theta_1$ between massage portion 2 and shaft 3, and has a plurality of annular portion 20' at the periphery that is made of material, softer than that of insert member 20 and prevents massage portion 2 and the shaft 4 from being released from a firm coupling.

The annular portion 20' of the insert member 20 is so flexible that it is bent in the direction of insertion when inserted into the massage portion 2 and the shaft 4, but not bent in the reverse direction, i.e. when the massage portion 2 and the shaft 4 are released after assembled.

With the above configuration the massage portion 2 and the shaft 4 can not be released after coupling through the insert member 20, thereby securing the steady connection therebetween.

FIG. 10 to FIG. 15 illustrate the seventh to the eleventh embodiments of the massage stick according to the invention.

Regarding these embodiments, the massage stick takes the shape of letter "T". In the seventh embodiment disclosed in FIG. 10 massage portion 2 having culm portion 3 at both ends is prepared, and then in the middle of the length of the massage portion 2 a through hole is formed. Then one end of shaft 4 is inserted into the through hole to be connected to the massage portion 2 in the shape of letter "T".

The through hole has a certain inclination relative to the shaft 4. In other words, as in previous embodiment, massage portion 2 is inclined to the shaft 4 at an angle of $\theta_2$.

Further both ends of the massage portion 2 is cut inwardly and outwardly, for example at an angle of $\theta_1$, so that one end 21 of massage portion 2 is suitable for patting on the leg, while the other end 21' is for the back.

Figure 11:
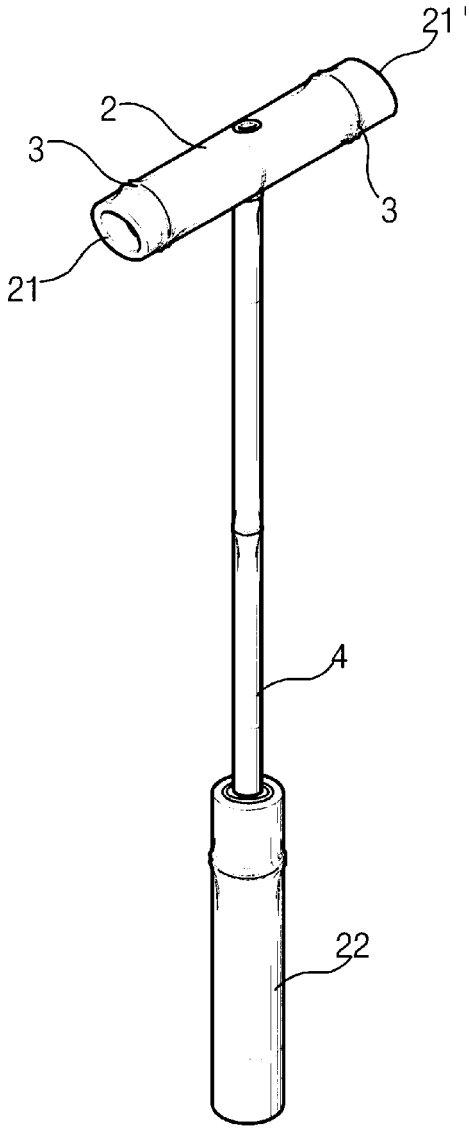
FIG. 11 is a perspective view of the massage stick of the eighth embodiment according to the invention.

FIG. 11 illustrates the eighth embodiment of the massage stick according to the invention.

Figure 12:
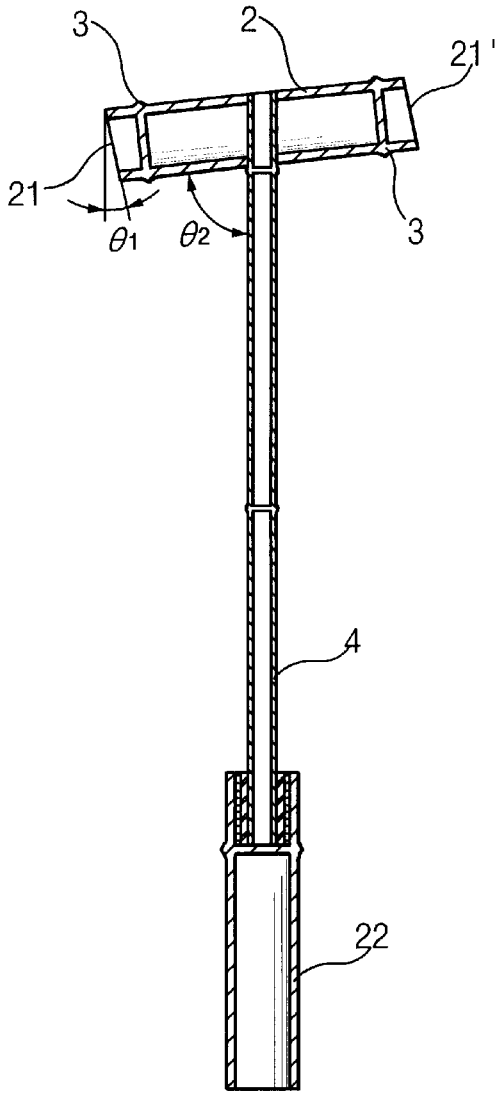
FIG. 12 is a cross sectional view of the stick showed in FIG. 11.

The characteristic of this embodiment is that grip member 22 is additionally provided at one end of shaft 4 for grasping by the user. A short bamboo stick having a proper diameter, as shown in FIG. 12, may be used as the grip member 22.

Figure 13:
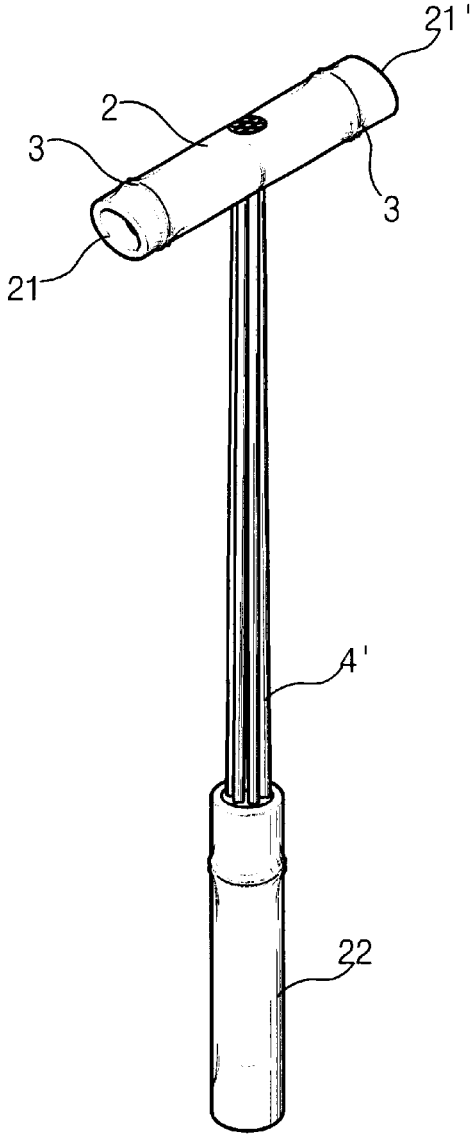
FIG. 13 is a perspective view of the massage stick of the ninth embodiment according to the invention.

FIG. 13 illustrates the ninth embodiment of the bamboo massage stick according to the invention. In this embodiment, in stead of shaft 4 in the eighth embodiment, a number of the bamboo strips 4 are used, thereby providing on one hand tension to the grip member 22 and on the other hand an aesthetic pleasure to user.

Figure 14:
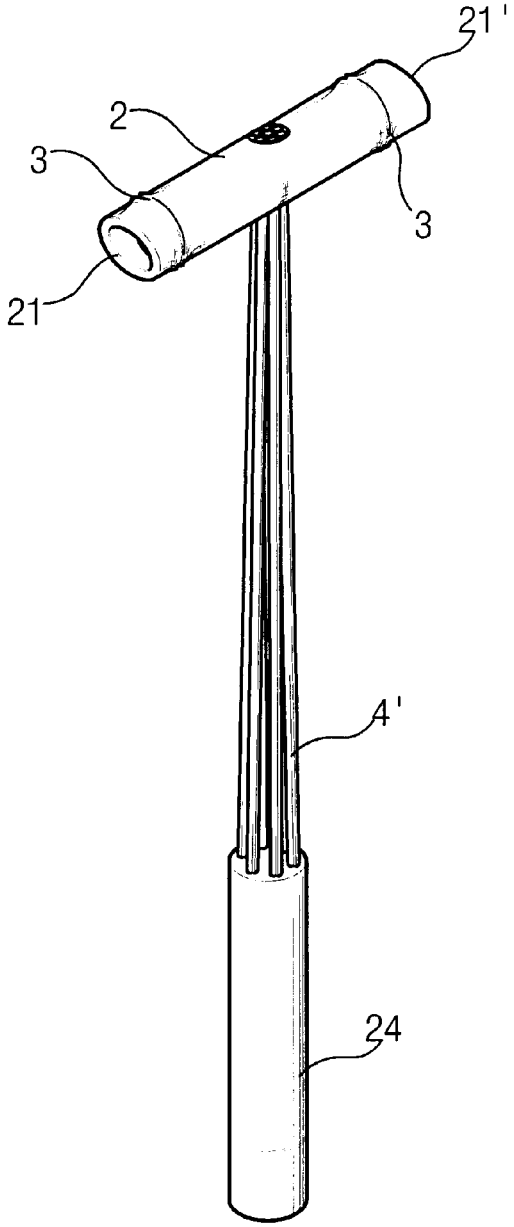
FIG. 14 is a perspective view of the massage stick of the tenth embodiment according to the invention.

FIG. 14 illustrates the tenth embodiment of the bamboo massage stick according to the invention, in stead of grip member 22 as shown in FIG. 13, grip member 24 made of a Chinese juniper is being used.

Figure 15:
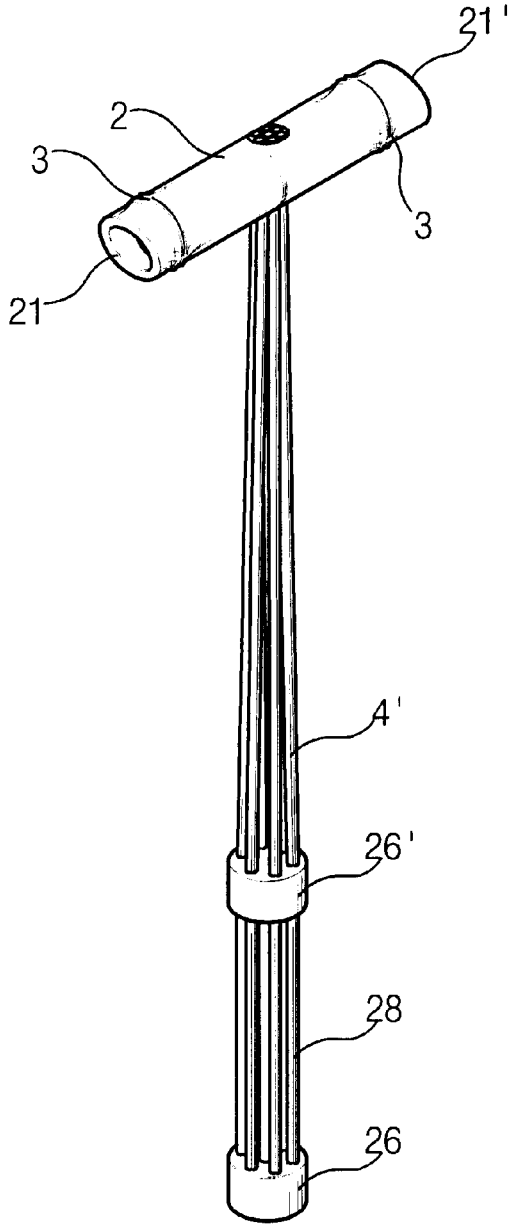
FIG. 15 is a perspective view of the massage stick of the eleventh embodiment according to the invention.

FIG. 15 illustrates the eleventh embodiment of the bamboo massage stick according to the invention. In this embodiment, in stead of grip member 24 in FIG. 14, two joint members 26, 26' are provided to form grip portion 28 therebetween. The grip portion 28 may stimulate the palm of the user when griped by the hand. The joint member 26' may be located at one third of the entire length of the shaft.

It will be appreciated that various modifications of the present invention may be undertaken by those skilled in the art without departing from the spirit and scope hereof.

What is claimed is:

1. A massage stick made of bamboo for use on a human body comprising:

a massage portion having a culm portion and an end portion providing a recessed space, a shaft for supporting said massage portion, such that a substantially L-shaped configuration is formed when the massage portion is coupled to the shaft, an angle ($\theta_2$) between said massage portion and said shaft forming said substantially L-shaped configuration being greater than 80 degrees, wherein said end portion is inclined relative to a line parallel with the shaft and less than 90 degrees.

2. The message stick made of bamboo as claimed in claim 1, wherein a single bamboo stick is partially cut and curved to form the massage portion and the shaft from said single bamboo stick.

3. The massage stick made of bamboo as claimed in claim 2, wherein the massage portion and the shaft are coupled by a tape member, thereby forming a curved portion.

4. The massage stick made of bamboo as claimed in claim 2, wherein the massage portion and the shaft are coupled by a tubular member, thereby forming a curved portion.

5. The massage stick made of bamboo as claimed claim 1, wherein the massage portion and the shaft are separately prepared, and then the massage portion is coupled to the shaft by one selected from the group consisting of a coupling member, pin members, a segmental plate, and an insert member.

6. The massage stick made of bamboo as claimed in claim 1, wherein the massage portion has the end portion that is cut at an angle ($\theta_1$), ranging from an angle of 10 degrees to 14 degrees relative to a line parallel with the shaft.

7. The message stick made of bamboo as claimed in claim 1, wherein the angle ($\theta_2$) formed where the massage portion is coupled to the shaft ranges from an angle of 82 degrees to 85 degrees.

8. The massage stick made of bamboo as claimed in claim 1, further comprising a grip member positioned in a lower portion of the shaft for holding said shaft.

9. The massage stick made of bamboo as claimed in claim 1, wherein said culm portion is defined by an exterior portion of said bamboo and a naturally occurring stem segment thereof which separates said recessed space from an interior of a remainder of said massage portion, said end portion end of said culm portion opposite said stem segment being cut at an angle ($\theta_2$) of between 10 and 14 degrees relative to a line parallel with said shaft.

10. The massage stick made of bamboo as claimed in claim 1, wherein said massage portion is made of a first piece of bamboo and said shaft is made of a second piece of bamboo, said first piece and said second piece each provided with at least one angled throughhole into which a pin is inserted extending from and coupling said first piece to said second piece.

11. The massage stick made of bamboo as claimed in claim 10, wherein said first and second pieces are joined with cut faces angled to complement one another, said pin extending substantially perpendicular to said cut faces.

12. The massage stick made of bamboo as claimed in claim 1, wherein said massage portion is made of a first piece of bamboo and said shaft is made of a second piece of bamboo, said first piece and said second piece each provided with a slit on one side thereof, said slits in said first and second pieces being aligned and a segmental plate inserted therein to couple said first piece to said second piece.

13. The massage stick made of bamboo as claimed in claim 12, wherein said first and second pieces are joined with cut faces angled to complement one another, said segmental plate being a substantially triangular planar member.

14. The massage stick made of bamboo as claimed in claim 1, wherein said massage portion is made of a first piece of bamboo and said shaft is made of a second piece of bamboo, said first and second pieces being inserted into a coupling member that is curved at said angle.

* * * * *